US005305515A

United States Patent [19]

Fastert et al.

[11] Patent Number: 5,305,515

[45] Date of Patent: Apr. 26, 1994

[54] METHOD AND ARRANGEMENT FOR ROLLING HOT WIDE STRIPS FROM CONTINUOUSLY CAST THIN SLABS

[75] Inventors: Herbert Fastert, Franklin Lakes, N.J.; Wolfgang Rohde, Dormagen, Fed. Rep. of Germany; Dieter Nobis, Neuss, Fed. Rep. of Germany; Hans Malinowski, Düsseldorf, Fed. Rep. of Germany

[73] Assignee: SMS Schloemann-Siemag Aktiengesellschaft, Dusseldorf, Fed. Rep. of Germany

[21] Appl. No.: 812,802

[22] Filed: Dec. 23, 1991

[30] Foreign Application Priority Data

Dec. 21, 1990 [DE] Fed. Rep. of Germany ..... 4041205

[51] Int. Cl.[5] ..... B21B 1/46; B21B 15/00

[52] U.S. Cl. ..... 29/527.7; 29/33 C; 29/33 P; 266/274; 266/276; 266/277; 432/128

[58] Field of Search ..... 29/527.7, 33 P, 33 C; 266/276, 274, 277; 432/128

[56] References Cited

U.S. PATENT DOCUMENTS

| | | | |
|---|---|---|---|
| 4,217,095 | 8/1980 | Tokitsu | 29/527.7 X |
| 4,229,878 | 10/1980 | Ushijima | 29/527.7 |
| 4,586,897 | 5/1986 | Weber et al. | 266/276 X |
| 5,014,412 | 5/1991 | Nobis et al. | 29/527.7 |
| 5,020,208 | 6/1991 | Feldmann et al. | 29/527.7 |
| 5,115,547 | 5/1992 | Rohde | 29/527.7 X |
| 5,117,545 | 6/1992 | Giusto | 29/527.7 X |

FOREIGN PATENT DOCUMENTS

| | | | |
|---|---|---|---|
| 55-45530 | 3/1980 | Japan | 29/527.7 |
| 61-176402 | 8/1986 | Japan | 29/527.7 |

*Primary Examiner*—Carl J. Arbes

*Attorney, Agent, or Firm*—Anderson Kill Olick & Oshinsky

[57] ABSTRACT

A method and an arrangement for rolling hot wide strips from continuously cast thin slabs in successive steps of operation of a rolling line which includes a continuous finishing train. One or more casting lines and individual thin slabs are severed from the cast strand. The thin slabs are homogenized and adjusted to rolling temperature in an equalizing furnace and the thin slabs are transferred from the equalizing furnace to the rolling line. Roller-type turning furnaces provided in each of the casting lines and in the rolling line are use by turning the roller-type turning furnaces toward each other into positions which are inclined relative to the casting and rolling lines in the manner of switches for alternatingly conveying thin slabs from one of the casting lines through the roller-type turning furnaces into the rolling line.

10 Claims, 4 Drawing Sheets

A
B
C
1
2
3
4a
4b
5
6a
6b
7
8
8a
9
10
11
12
13
14
15
16
18a
18b
19
19c
20
20a
21
x
x
240S ≡ L
0
50
70
100
150
200
70
30
60
30
120
30
60
30
120

METHOD AND ARRANGEMENT FOR ROLLING HOT WIDE STRIPS FROM CONTINUOUSLY CAST THIN SLABS

BACKGROUND OF THE INVENTION

1. Field of the Invention

The present invention relates to a method and an arrangement for rolling hot wide strips from continuously cast thin slabs in successive steps of operation of a rolling line which includes a continuous finishing train. The method includes producing continuously cast strands in one or more casting machines or casting lines and severing individual thin slabs from the cast strand and homogenizing and adjusting to rolling temperature the thin slabs in an equalizing furnace provided in each casting line and transferring the slabs from the equalizing furnace to the rolling line.

2. Description of the Related Art

The following types of arrangements are known for two-strand and three-strand plants:

The thin slabs, arriving from different continuous casting machines, initially travel through an equalizing furnace, and are subsequently subjected to a breaking-down treatment and are then wound into coils. The coils are transported by means of various conveying means in the covered slate to the center line of the CSP rolling mill train (CSP compact strip production) and, after uncoiling, for example, in a coil box, are conveyed to the rolling mill train.

In order to have available more buffer possibilities, German Offenlegungsschrift 38 21 188.2 discloses an intermediately arranged rotary hearth furnace, which is capable of keeping the wound coils hot. The known method and the corresponding arrangement provide that the initial material is adjusted to hot-rolling temperature after solidification and is wound into coils, is intermediately stored in a rotary hearth furnace and is called up as desired, and is uncoiled and rolled into finished strips. It is particularly advantageous if the intermediate storage occurs immediately before the entry into the finishing train. Afterheating can be carried out during the intermediate storage.

In accordance with another type of arrangement, one or two transversely movable furnace conveyors are arranged at the ends of the equalizing furnaces, which extend parallel to each other and are arranged following each continuous casting machine. The furnace conveyors move the thin slabs into the region of the rolling mill train or the rolling line.

Finally, another known type of arrangement provides that two or three continuous casting machines or casting lines are arranged offset and at an angle relative to each other. The equalizing furnaces are also arranged in an angularly offset configuration in the casting lines. A roller conveyor is provided at the ends of the equalizing furnaces. The roller conveyor receives the thin slabs from the furnaces and swings the thin slabs in the manner of a turntable into the rolling line and feeds them to the rolling mill in this manner.

The known types of arrangements start, in part, from the same objects which are, inter alia, the requirements to reduce as much as possible the temperature losses of the continuously cast initial material on the way into the rolling mill and, for this purpose, in addition to providing suitable heat-insulating features, to maintain short conveying distances and conveying periods. In addition, it is another object to harmonize the casting capacities of several casting machines and the rolling capacity of a subsequent rolling mill in such a way that the entire plant is utilized with as few losses as possible in order to achieve an economically favorable operation. Also, the space required by the plants and, thus, the investment costs should be minimized.

In order to convey continuously cast thin slabs of different casting lines without problems and quickly into a rolling line, it is always necessary to provide special additional conveying units in the arrangement. Required for this purpose are, for example, transverse conveying units and/or displacement units or also coiling units which are not only structurally very complicated, but also require substantial space because the thin slabs are up to 60 m long. As a consequence, the investment costs and operation costs are very high.

SUMMARY OF THE INVENTION

Therefore, it is the object of the present invention to provide a method and a corresponding arrangement of the above-described type in which the feeding of continuously cast initial materials, particularly from several casting lines which are located next to each other and include equalizing furnaces, into a corresponding rolling line of a rolling mill, is made possible in a particularly simple and inexpensive manner which is space-saving and time-saving and which, thus, makes possible that several continuous casting plants are connected without problems and inexpensively to a hot rolling mill.

In accordance with the present invention, in a method of the above-described type, conventional roller-type turning furnaces, provided in each of the casting lines and also in the rolling line are used by turning the roller-type turning furnaces toward each other into positions which are inclined relative to the casting and rolling lines in the manner of switches for alternatingly conveying thin slabs from one of the casting lines through the roller-type turning furnaces into the rolling line.

The roller-type turning furnaces, which are used in accordance with the present invention are commercially produced by, in the United States among others, the firm L.O.I Inc. Industrial Furnaces, of 2000 Oxford Drive, Bethelpark, Pittsburgh, Pa. 15102.

The method according to the present invention provides the following advantages as compared to known methods and arrangements, for example, those including transversely movable conveyors:

The turning procedure requires less than half the time of the conveying procedure of a furnace-type transverse conveyor.

The turning drive and the construction of the roller-type turning furnace are significantly simpler than technical requirements of transversely movable conveyors.

Transversely movable furnace-type conveyors, as well as turning furnaces require connections for media of all type. While these connections are effected in a furnace-type transverse conveyor through complicated drag chains for the media, the turning furnace arrangement means that there is a fixed point of rotation at which all lines for supplying and discharging media can be conducted in a simple manner.

If necessary, a flue gas outlet can be arranged above each fixed point of rotation. In transversely movable conveyors, such outlets are very complicated to realize.

In accordance with a further development of the method, according to the present invention, a thin slab each is moved within its casting line into a roller-type turning furnace and is turned, together with this furnace, into an inclined switching position in direction toward the rolling line by a certain angle and the roller-type turning furnace of the rolling line is also turned in direction toward the casting line by the same angle into an inclined switching position, such that both turning furnaces are aligned in a straight line and the free ends thereof are joined to each other. Subsequently, the slab is conveyed from the turning furnace of the casting line to the turning furnace of the rolling line. Both turning furnaces are then turned back into the initial positions and the slab is finally moved from the turning furnace of the rolling line into the finishing train.

In an arrangement for rolling hot wide strip from continuously cast thin slabs by means of a rolling line which includes a continuous finishing train, wherein the arrangement includes at least two parallel, single-strand casting machines or casting lines with means for severing individual thin slabs from the produced strands and with an equalizing furnace for each line, and wherein the arrangement includes means for alternatingly conveying thin slabs from one casting line into the rolling line, the present invention provides that each casting line and the rolling line have a roller-type turning furnace, wherein the turning furnaces of the casting lines and of the rolling line are longitudinally offset relative to each other in conveying direction by approximately a length of a turning furnace, and wherein the turning points of the turning furnaces of the casting lines are arranged at the rearward ends thereof in conveying direction and the turning point of the turning furnace of the rolling line is arranged at the forward end thereof in conveying direction, such that the turning furnace in the rolling line and the turning furnace in one of the casting lines form a straight-line transition from the casting line to the rolling line when the furnaces are turned into aligned positions in the manner of a switch.

The various features of novelty, which characterize the invention, are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DETAILED DESCRIPTION OF THE PREFERRED EMBODIMENTS

Figures 1, 2:
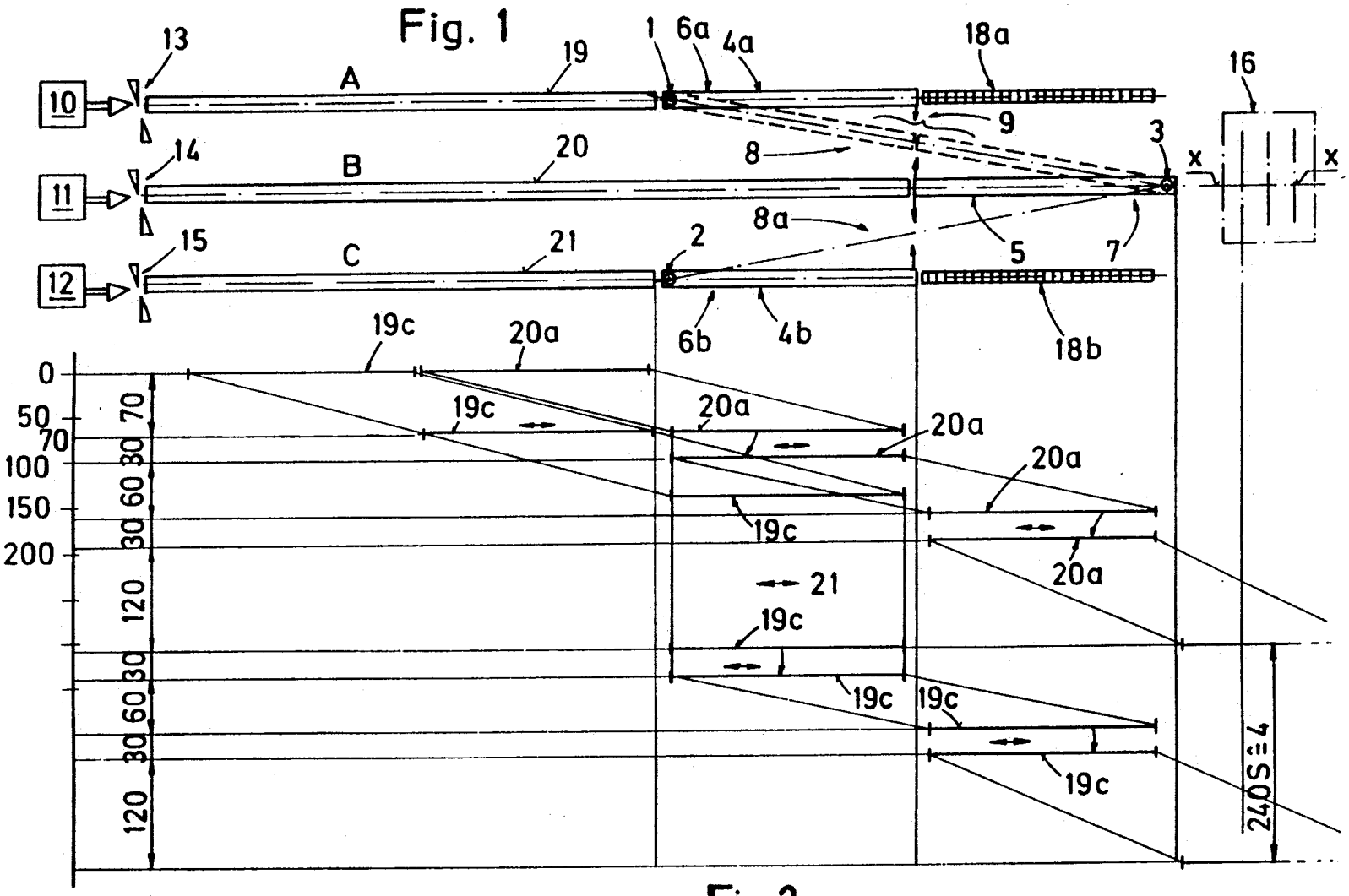
FIG. 1 is a schematic view of a CSP arrangement with three casting lines or continuous casting machines and a rolling line including a finishing train.
FIG. 2 is a schematic distance/time diagram showing the operation of the arrangement of FIG. 1.

The CSP arrangement, illustrated in FIG. 1, includes three strands or casting lines A, B, C each including a continuous casting machine 10, 11, 12, respectively. The casting machines are following by cutting devices 13, 14, 15 for dividing the cast strands and equalizing or holding furnaces 19, 10, 21 also follow the casting machines. The casting strand A, or its equalizing furnace 19, includes a roller-type turning furnace **4*a* and the casting strand C or its equalizing furnace 2 includes a roller-type turning furnace 4*b*. The casting strand B in the middle or its equalizing furnace 20 includes a roller-type turning furnace 5, which is followed by the rolling line x—x with the finishing train 16**.

In the illustrated arrangement, preferably always two strands are in operation, i.e., either A and B, A and C or B and C, while the respectively third strand is prepared for the next casting and remains in stand-by position. After a casting sequence has been concluded in one of the two strands, the strand which has remained in stand-by position, can immediately receive molten steel from the steel mill. This ensures that always two strands are in full production, while the third strand can be prepared for the next casting.

The most unfavorable situation occurs when both outer strands A and C are in production. A thin slab leaves the furnace 19, with the highest possible conveying speed and is conveyed into the turning furnace **4*a*, which is in its initial position. In the meantime, a preceding slab has already left the turning furnace 5 of the strand B in direction of the finishing train 16. Subsequently, as illustrated in FIG. 1 in broken lines, the turning furnace 4*a* is turned downwardly and the turning furnace 5 is turned upwardly. Thus, turning the turning furnaces 4 and 5 by the same angle of, for example, 10° into an inclined switching position 8, has the result that both furnaces 4*a* and 5 are joined at the free ends thereof and are aligned in a straight line and, in this oppositely directed turning position, interact in the manner of a switch 8 to form a straight-line transition 9 from the casting line 8 to the rolling line x—x. The thin slab in the turning furnace 4*a* is moved in the furnace 4*a* in an oscillating manner during the turning procedure, is conveyed from the turning furnace 4*a* into the turning furnace 5. Subsequently, the turning furnace 4*a* is turned into the horizontal plane, i.e., in the illustration of FIG. 1, is moved toward the top and the turning furnace 5 is turned downwardly into the initial position thereof. The thin slab is now conveyed from the turning furnace 5 into the rolling line x—x or the finishing train 16 and is finish-rolled in the finishing train in a passage of, for example, 120 seconds. As soon as the slab referred to above has left the turning furnace 5 in direction toward the rolling mill 16, the turning furnace 5 is turned downwardly and the turning furnace 4*b*** is turned upwardly. The procedure described above is then carried out in the same manner for a thin slab from the strand C.

In accordance with an important feature of the invention, the roller-type turning furnaces **4*a*, 4*b* of the strands A and C, on the one hand, and the turning furnace 5 of the strand B, on the other hand, are longitudinally offset in conveying direction by approximately the length of a turning furnace. The turning points 1, 2 of the turning furnaces 4*a* and 4*b* in the casting lines are located at the rearward ends 6*a*, 6*b* thereof in conveying direction and the turning point 3 of the turning furnace 5 in the rolling line is arranged at the forward end 7 thereof. As a result, a pair of furnaces 4*a*, 5 or 5, 4*b* can assume oppositely aligned turned positions shown in dash-dot lines in FIGS. 1–6 in the manner of a switch 8, such that the free ends of the furnaces are joined with each other and interact with each other and form a straight-line transition 9** from a casting line A, B, C to the rolling line x—x.

Since the turning furnaces 4a, 4b, 5 are heated in a simple manner through the fixed turning point 1, 2, 3, it is possible to convey the thin slabs after they have left the equalizing zone of the furnaces 19, 20, 21 with the highest possible conveying speed directly into the turning furnaces 4a, 4b and 5. This means that buffer zones are continuously maintained between the equalizing furnaces 19–21 and the turning furnaces 4a, 5, 4b, so that they can be used in case of any short-time problems occurring in the area of the rolling mill or for exchanging the work rolls. It is also possible to convey thin slabs from all three simultaneously producing strands A, B, C.

The arrangement according to the present invention may include different concepts, including the possibility of arranging a roller table 18a, 18b each in alignment with and following the initial position of the turning furnaces 4a, 4b. Each of the roller tables 18a, 18b can be used, for example, to receive damaged slabs as necessary. Damaged slabs from strand B, can also be conveyed onto the roller tables 18a, 18b, by using a reversing operation of the roller tables in the turning furnaces 4 and 4a, 4b.

FIG. 2 of the drawing is a distance/time diagram. The example shows a thin slab 19c of the strand or casting line C and a slab 20a of the strand or casting line A. Both slabs are about 50 m long. The slab 19c is conveyed in the equalizing furnace 21 by the length of a slab and requires, for this travel, about 70 seconds as indicated in the ordinate showing the time. The slab 19c is then conveyed in another 70 seconds into the turning furnace 4b and initially remains in waiting position, in which the slab is moved back and forth in an oscillating manner, as indicated by double arrow 21. The slab 20a is conveyed further from its position at the end of the equalizing furnace 19 within 70 seconds into the turning furnace 4a. Immediately subsequently to this conveying procedure, the turning furnace 4a is turned downwardly as shown in the illustration of FIG. 1. This turning movement requires about 30 seconds during which time the slab is moved back and forth in an oscillating manner within the turning furnace. The turning furnace 5 has simultaneously carried out an upward turning movement, so that both turning furnaces 4a, 5 are located in the switching position 8, with the free ends thereof joining each other and form a straight-line transition 9 from strand A to strand B to the rolling line x—x. The slab 20a is now conveyed within about 60 seconds into the turning furnace 5 and the turning furnace 5 is turned back within 30 seconds into the initial position of the strand B or the rolling line x—x. Thus, the total duration of this procedure is approximately $70+30+60+30=190$ seconds. Subsequently, the slab 20a is moved into the finishing train 16, within approximately 120 seconds from the turning furnace 5, into the rolling mill 16. Subsequently, after the turning furnaces 4b and 5 have been moved into a common switching position 8a indicated by dash-dot lines, the slab 19c can be moved from the waiting position in the turning furnace 4b into the turning furnace 5. This turning movement requires 30 seconds and the transport from one furnace into the other requires 60 seconds, so that the slab is moved within 90 seconds into the turning furnace 5. Both turning furnaces 4b and 5 turn back into their initial positions within 30 seconds. The slab is now conveyed in the same manner, as described above from the turning furnace 5 into the finishing train 16 and is conveyed within another 120 seconds in the entry in the finishing train 16 from the turning furnace 5. Thus, 240 seconds or 4 minutes are available for the production of a thin slab in two producing casting lines A/B or B/C.

FIGS. 3–7 of the drawings show further possibilities of the present invention for arranging turning furnaces instead of, for example, complicated transversely movable furnace conveyors. FIGS. 3–7 of the drawing together show the high degree of flexibility in the layout of arrangements according to the present invention for manufacturing hot-rolled steel strip with the use of turning furnaces.

Figure 3:
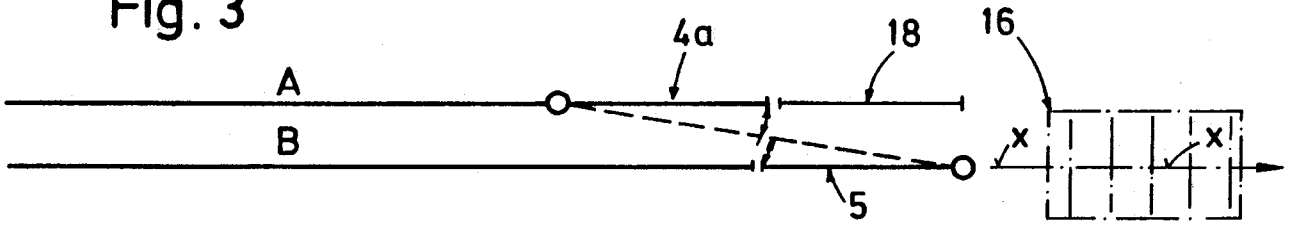
FIGS. 3–7 are schematic views of arrangements according to the present invention with two strands, three strands and one strand, respectively.

For example, FIG. 3 of the drawings shows a two-strand CSP arrangement in which strand B is arranged in line with the rolling line x—x. The casting strand A is parallel offset at a distance of casting line B and includes the turning furnace 4a, while the casting line B includes the turning furnace 5.

Figure 4:
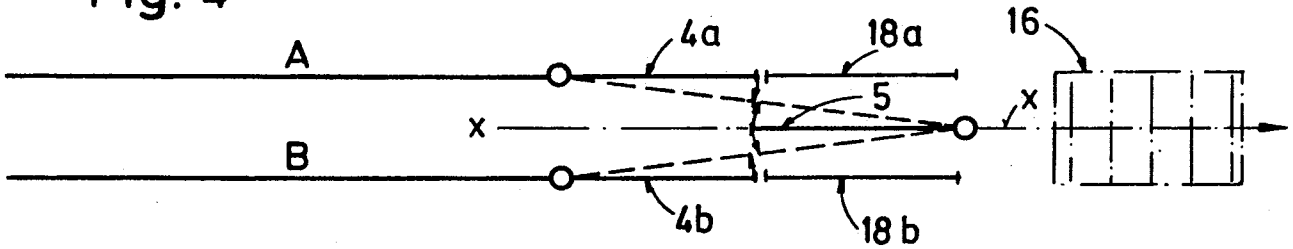

FIG. 4 of the drawings shows another embodiment of a two-strand arrangement in which the rolling line x—x is arranged in the middle between two casting strands A and B.

Figure 5:
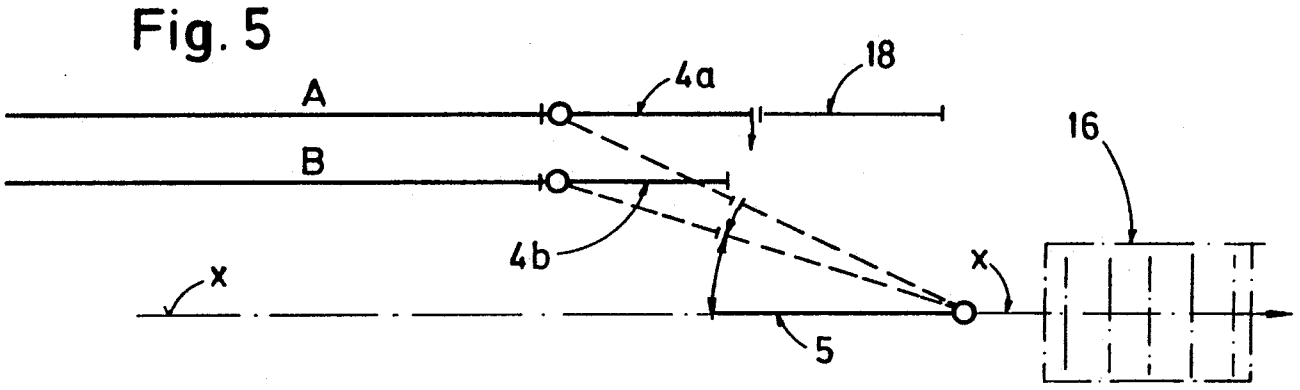

FIG. 5 shows another arrangement which may be used if unfavorable conditions with respect to space makes this necessary. In this case, the casting strands A and B are arranged parallel to and at a distance from the rolling line x—x. In the case of an arrangement of a transversely movable furnace conveyor or of two furnace conveyors, the travel time of these conveyors would be much too great for ensuring the required production while being adapted to the casting capacity and rolling capacity. Another disadvantage of the transversely moved conveyors would result when the conveyors are hindering each other, a situation which cannot always be excluded.

The above-mentioned disadvantages and technical limitations are avoided, in an advantageous manner, by using the arrangement of three turning furnaces 4a, 4b and 5 as shown in FIG. 5. This arrangement makes it possible to obtain, without problems, a continuous operation with turning times of always only 30 seconds.

Figure 6:
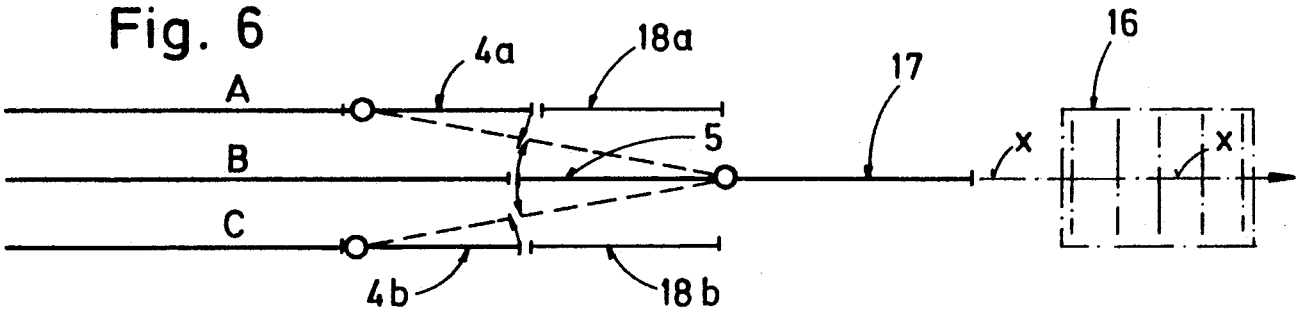

FIG. 6 of the drawings shows another type of arrangement which is similar to the one shown in FIG. 1. FIG. 6 additionally shows a stationary holding furnace 17, which is arranged additionally in front of the finishing train 16. The holding furnace 17, ensures an independent operation and, thus, a faster and more flexible operation. Because of the arrangement of the holding furnace 17, the conveyor rollers in the turning furnace 5 can discharge the thin slabs with the highest possible conveying speed, so that the turning furnace 5 is again available for receiving another thin slab within a very short time, for example, within 60 or 70 seconds.

The holding furnace 17 described above can also be used in the same manner in the arrangements described with respect to FIGS. 3, 4, 5 and 7. The advantages are the same as the ones described above.

Figure 7:
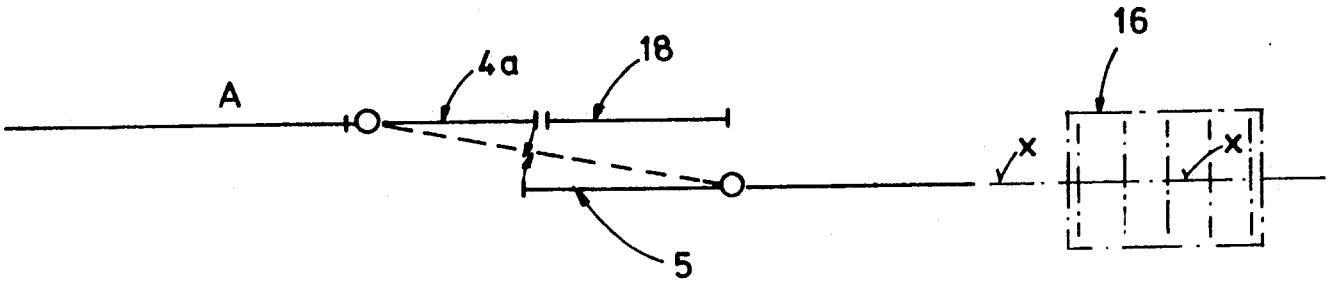

FIG. 7 shows the arrangement of only one casting strand in unfavorable conditions with respect to available space. The arrangement includes a casting line A and rolling line x—x which is offset at a distance and extends parallel to the casting line A. The casting line A and the rolling line x—x, each include a turning furnace 4a and 5, respectively. In order to extend the turning furnace 4a, it is advantageous to arrange a runout roller table following the turning furnace 4a.

While specific embodiments of the invention have been shown and described in detail to illustrate the inventive principles, it will be understood that the invention may be embodied otherwise without departing from such principles.

We claim:

1. A method of rolling hot-rolled wide strips from continuously cast thin slabs in successive steps of operation of a rolling line which includes a continuous finishing train, said method comprising the steps of:

producing continuously cast strands in a plurality of casting lines;

severing individual thin slabs from the cast strands;

homogenizing and adjusting to rolling temperature the thin slabs in equalizing furnaces provided in the plurality of casting lines;

providing a roller-type turning furnace in each of the casting lines after the equalizing furnace and the roller line for alternately conveying thin slabs from one of the casting lines into the rolling line; and turning the roller-type turning furnaces toward each other into positions which are inclined relative to the casting and rolling lines thereby to form a switch between the casting lines and the rolling line.

2. The method of claim 1, comprising the steps of:

moving a thin slab within one of the casting lines into the roller-type turning furnace of said casting line;

turning the thin slab, together with the roller-type turning furnace, from an initial position into an inclined switching position in a direction toward the rolling line by a predetermined angle;

turning the roller-type turning furnace of the rolling line in a direction toward the casting line, by the predetermined angle from an initial position into an inclined switching position, such that both roller-type turning furnaces are aligned in a straight line and free ends of the furnaces are joined to each other;

thereafter conveying the thin slabs from the roller-type turning furnace of the one casting line to the roller-type turning furnace of the rolling line;

turning both roller-type turning furnaces back into the initial positions; and finally moving the thin slab from the roller-type turning furnace of the rolling line into the finishing train.

3. The method of claim 1, wherein the roller-type turning furnaces of the casting lines each have a rearward turning point in a conveying direction of the slabs; and the roller-type turning furnace of the rolling line has a forward turning point in the conveying direction of the slabs; and wherein the turning point of the turning furnace of the rolling line is located approximately two lengths of a turning furnace in front of the turning points of the roller furnaces in the casting line.

4. The method of claim 1, wherein the roller-type furnace in one of the casting lines an the roller-type furnace in the rolling line are turned by the same angle.

5. The method of claim 2, further comprising the step of oscillating a thin slab back and forth upon the roller-type turning furnaces between the initial and inclined positions thereof.

6. The method of claim 1, further including the step of synchronously turning all of the turning furnaces between an initial position thereof and an inclined position thereof.

7. A arrangement for rolling hot wide strips from continuously cast thin slabs in a rolling line which includes a continuous finishing train, said arrangement comprising:

a plurality of casting lines for producing cast strands;

means for severing individual thin slabs from the produced cast strands;

an equalizing furnace in each of the plurality of casting line; and means for alternatively conveying thin slabs from a casting line to the rolling line, wherein the conveying means comprises a roller-type turning furnace in each of the plurality of casting lines and in the rolling line, the roller-type turning furnace of the casting lines and the roller-type turning furnace of the rolling line being longitudinally offset relative to each other in conveying direction of the thin slabs approximately by a length of a roller-type turning furnace;

and wherein each of the roller-type turning furnaces has a turning point, the turning points of the turning furnaces of the casting lines being arranged at a rearward end of the turning furnaces in a conveying direction, and the turning point of the turning furnace of the rolling line being arranged at a forward end of the turning furnace in the conveying direction, so that the turning furnace in the rolling line and the turning furnace in a respective one of the casting lines form a straight-line transition from the respective casting line to the rolling line, when the furnaces are turned into aligned positions in the manner of a switch.

8. The arrangement of claim 7, further comprising means for supplying and discharging energy and operating media like electricity, compressed air, gas, cooling media, wherein the supplying and discharging means extends through the turning point of each roller-type turning furnace.

9. The arrangement of claim 7, wherein each casting line comprises a runout roller conveyor following the turning furnace in the conveying direction.

10. The arrangement of claim 7, further comprising a holding furnace located between the turning furnace of the rolling line and the finishing train.

* * * * *